US008153046B2

(12) United States Patent
McCary

(10) Patent No.: US 8,153,046 B2
(45) Date of Patent: Apr. 10, 2012

(54) WALL FORMING SYSTEM

(76) Inventor: John M. McCary, Birmingham, AL (US)

( * ) Notice: Subject to any disclaimer, the term of this patent is extended or adjusted under 35 U.S.C. 154(b) by 50 days.

(21) Appl. No.: 12/198,937

(22) Filed: Aug. 27, 2008

(65) Prior Publication Data

US 2010/0051779 A1 Mar. 4, 2010

(51) Int. Cl.
*B28B 3/00* (2006.01)

(52) U.S. Cl. ..... 264/333; 264/273; 249/33

(58) Field of Classification Search ..... 264/273, 264/333; 249/33

See application file for complete search history.

(56) References Cited

U.S. PATENT DOCUMENTS

| | | | | |
|---|---|---|---|---|
| 2,110,335 | A * | 3/1938 | Kritzer | 427/264 |
| 4,706,429 | A | 11/1987 | Young | |
| 4,879,855 | A * | 11/1989 | Berrenberg | 52/309.11 |
| 5,390,459 | A | 2/1995 | Mensen | |
| 5,598,675 | A | 2/1997 | Pruss | |
| 5,611,183 | A * | 3/1997 | Kim | 52/426 |
| 5,687,522 | A * | 11/1997 | Durand et al. | 52/414 |
| 6,199,334 | B1 | 3/2001 | Malloy | |
| 6,378,263 | B1 * | 4/2002 | Sobers | 52/514 |
| 6,379,080 | B1 * | 4/2002 | Saffo, Sr. | 404/118 |
| 6,951,435 | B1 * | 10/2005 | Fennessy, Sr. | 404/75 |
| 7,596,918 | B2 | 10/2009 | Hills | |
| 2007/0164484 | A1 * | 7/2007 | Piccolo | 264/333 |
| 2007/0193151 | A1 * | 8/2007 | Anderson | 52/302.3 |

FOREIGN PATENT DOCUMENTS

| | | | |
|---|---|---|---|
| AU | 759446 | | 11/2002 |
| AU | 2004201477 | B2 | 10/2004 |
| WO | 03/040487 | A1 | 5/2003 |

* cited by examiner

*Primary Examiner* — Yogendra Gupta
*Assistant Examiner* — Amjad Abraham
(74) *Attorney, Agent, or Firm* — Kenneth M. Bush; Bush Intellectual Property Law

(57) ABSTRACT

A wall forming system utilizing flowable construction materials, such as concrete, to construct walls. The wall forming system comprises a wall forming assembly and a method of using the wall forming assembly to form a wall having an exterior surface. The wall forming assembly comprises an exterior first panel having a plurality of openings therethrough and a second panel. The first and second panels are spaced apart so that a cavity is formed therebetween for receiving the flowable construction material. The flowable construction material will flow through the openings in the exterior panel and extend beyond an external surface of the exterior panel. The flowable construction material that extends beyond the external surface can be shaped to form various surface designs. The exterior panel and the flowable construction material become a substantially monolithic structure when the flowable construction material is set.

10 Claims, 7 Drawing Sheets

WALL FORMING SYSTEM

FIELD OF THE INVENTION

The present invention relates to wall forming systems utilizing flowable construction materials, such as concrete, to construct walls.

BACKGROUND OF THE INVENTION

The process of constructing a poured concrete wall has conventionally required concrete forms to be created on site, wherein the concrete forms consist of wood, metal, or wood/metal panels erected and maintained in spaced, parallel relationship with other panels. Fluid concrete is then poured within the concrete forms, which are removed after the concrete has set (i.e. solidified). Problems associated with this process include higher labor costs, lack of uniformity, and expense associated with the removal and disposal of the panels. Various wall forming systems have been developed to overcome the problems found with this process.

One such development has been the use of prefabricated insulated concrete forms ("ICFs") comprising foam plastic panels wherein the forms become part of the poured concrete wall structure. Problems associated with this system have arisen due to the outside panels being made of a foam plastic, which include penetrability of the foam plastic, insect and water barrier difficulties, and the stigma of previous exterior foam plastic application failures.

Another development has been a wall form structure such as that disclosed in U.S. Pat. No. 5,611,183 to Kim, the disclosure of which is incorporated herein by reference. Kim avoids many of the problems found in prior art systems; however, Kim teaches an outer wall separate from the solidified concrete, which requires an exterior layer to be subsequently applied over the outer wall to protect the outer wall as well as to provide a decorative exterior surface.

Accordingly, what is needed, and is not found in the prior art, is a wall forming system utilizing a flowable construction material to construct walls wherein the exterior panels of the wall forming assembly become incorporated within the construction material after it has solidified.

SUMMARY OF THE INVENTION

The present invention is a wall forming system utilizing flowable construction materials to construct walls. The wall forming system comprises a wall forming assembly and a method of using the wall forming assembly to form a wall having an exterior surface. As used herein, flowable construction materials are fluid materials used in the construction industry that are capable of being poured, pumped, sprayed, and the like, and which will become set in place after a period of time. Thus, flowable construction materials include cementitious materials, such as concrete, and other materials capable of solidifying to form a substantially rigid structure.

A preferred embodiment of the wall forming assembly comprises an exterior first wall structure made from at least one exterior first panel, wherein each exterior first panel comprises lattice framework having a plurality of openings therethrough. The openings are sized to allow the flowable construction material to flow through the openings such that the flowable construction material extends beyond an external surface of the exterior first panel. The flowable material that extends beyond the external surface of the exterior first panel can be troweled or otherwise shaped to form various surface designs. The wall forming assembly may also include a stencil attached to the external surface of the exterior first panel, wherein the stencil can be removed before the construction material has solidified to provide various relief designs. The wall forming assembly further comprises a second wall structure made from at least one second panel, which may be used for an internal hidden wall or an external exposed wall. If used for an internal hidden wall, the second panel preferably comprises a solid panel. If used for an external exposed wall, the second panel preferably also comprises a lattice framework having a plurality of openings. The first and second panels are spaced apart so that a cavity is formed therebetween for receiving the flowable construction material. The exterior panel(s) and the flowable construction material become a substantially monolithic structure when the flowable construction material is set. The wall forming assembly can be formed with an existing wall or can be a modular unit, which can be attached to an existing wall or set up as a free standing structure. The wall forming assembly may also include additional layers of panels.

A preferred method of forming a wall having an exterior surface comprises the steps of introducing a flowable construction material into a wall forming assembly as described above, allowing some of the flowable construction material to flow through the openings in the exterior panel(s) such that the flowable construction material extends beyond an external surface of the exterior panel(s), shaping the flowable construction material that extends beyond the external surface of the exterior panel(s) to achieve a desired surface appearance, and waiting for the flowable construction material to solidify such that the exterior panel(s) and the flowable construction material become a substantially monolithic structure. If present, a stencil would be removed from the external surface of the exterior panel(s) before the flowable construction material is set. If desired, an exterior coating can be applied to the external surface of the flowable construction material that extends beyond the external surface of the exterior panel(s) to achieve a desired decorative appearance.

These and other features of the invention will become apparent from the following detailed description of the preferred embodiments of the invention.

DETAILED DESCRIPTION OF THE PREFERRED EMBODIMENTS

Figure 1:
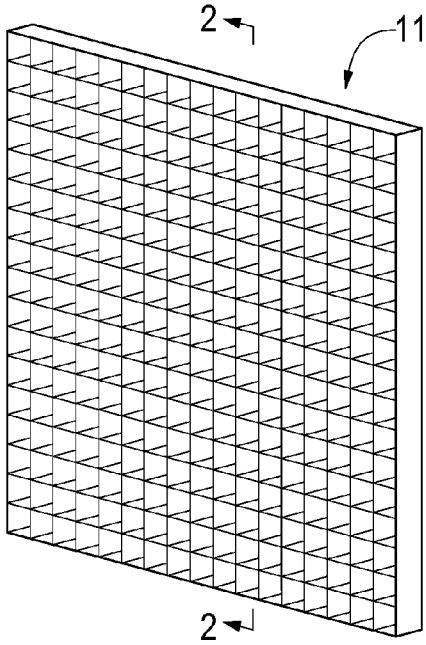
FIG. 1 is a perspective view of an exterior panel of the present invention.
Figure 2:
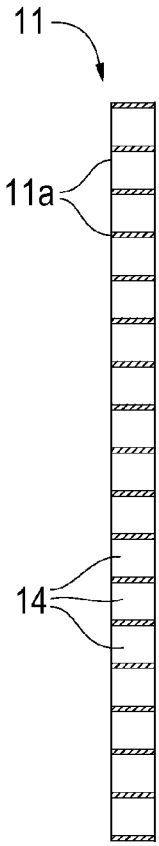
FIG. 2 is a side sectional view of the exterior panel of FIG. 1 taken along line 2-2.
Figure 3:
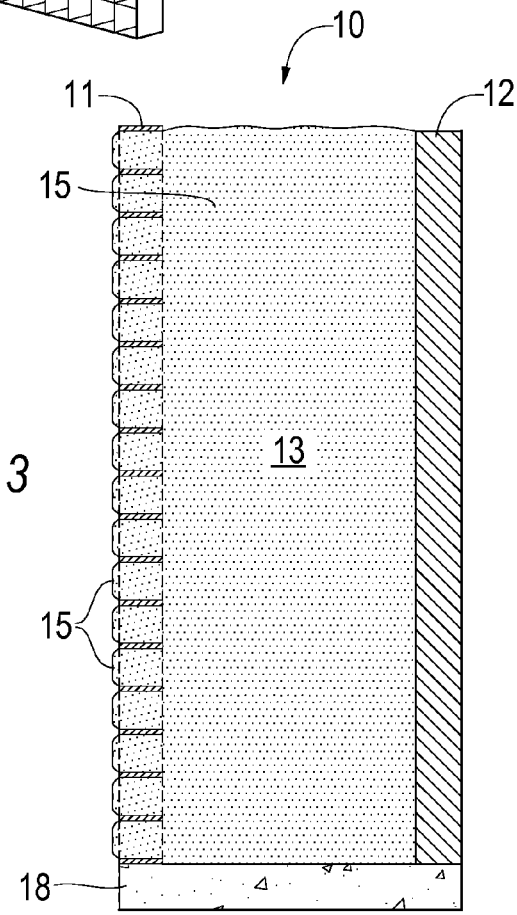
FIG. 3 is a side sectional view of a preferred embodiment of the wall forming assembly of the present invention having a flowable construction material therein.
Figure 4:
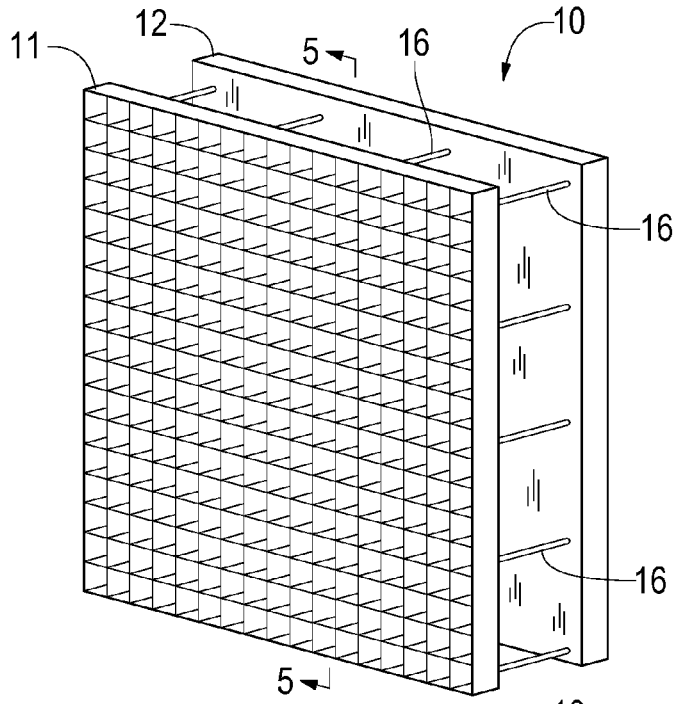
FIG. 4 is a perspective view of an alternate embodiment of the wall forming assembly of the present invention.
Figure 5:
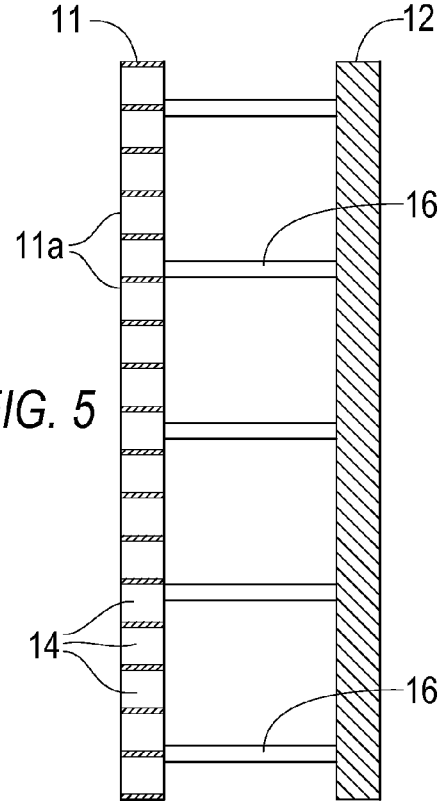
FIG. 5 is a side sectional view of the embodiment of FIG. 4 taken along line 5-5.
Figure 6:
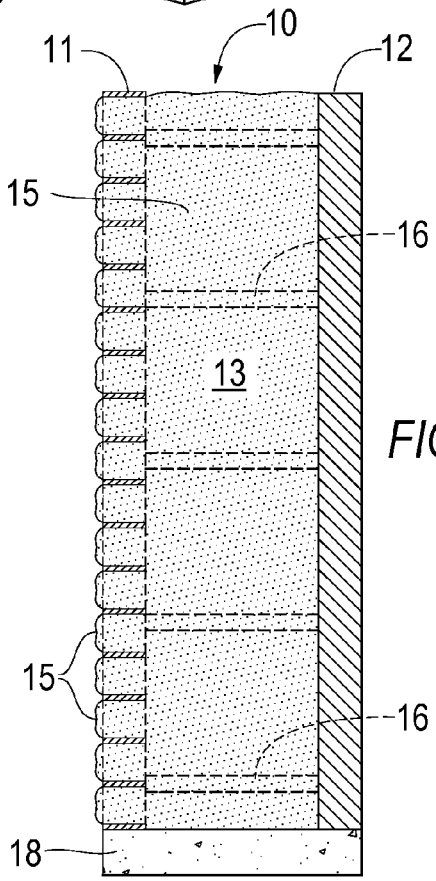
FIG. 6 is a side sectional view of the embodiment of FIG. 4 having a flowable construction material therein.
Figure 7:
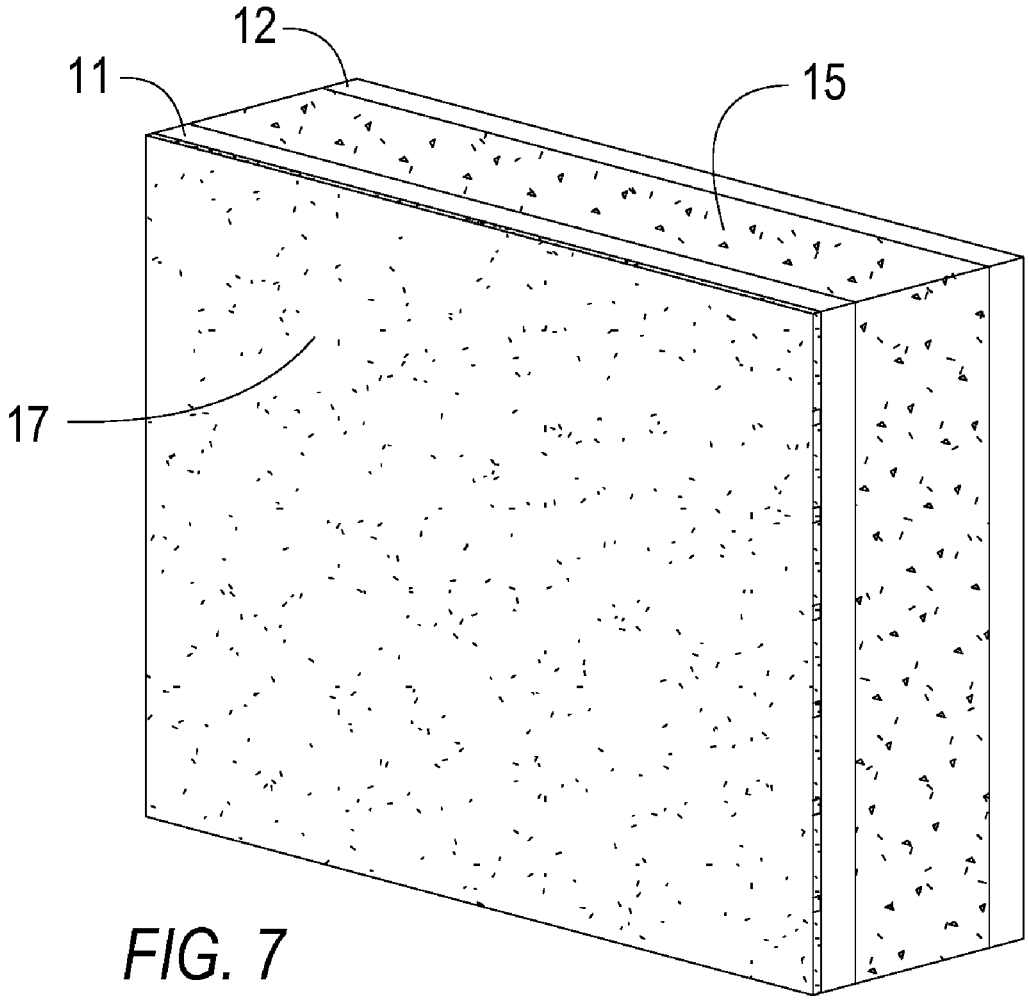
FIG. 7 is a perspective view of the wall forming assembly of the present invention having a flowable construction material therein with the exterior surface finished.

The present invention is a wall forming system utilizing flowable construction materials to construct walls. The wall forming system comprises a wall forming assembly and a method of using the wall forming assembly to form a wall having an exterior surface.

The preferred embodiments of the wall forming assembly are shown in FIGS. 1-15. The wall forming assembly 10 comprises a first wall structure and a second wall structure, wherein the first wall structure is an exterior wall made from at least one exterior first panel 11 and the second wall structure is made from at least one second panel 12. The first panel 11 and the second panel 12 are spaced apart so that a cavity 13 is formed therebetween for receiving the flowable construction material 15. Each exterior first panel 11 preferably comprises a plastic or metal lattice framework having a plurality of openings 14 therethrough. The size of the openings 14 depends on the viscosity and aggregate content of the flowable construction material 15 to be used, but the openings 14 are sized to allow the flowable construction material 15 to flow through the openings 14 such that the flowable construction material 15 extends beyond an external surface 11*a* of the exterior first panel 11. The flowable construction material 15 that extends beyond the external surface 11*a* of the exterior first panel 11 can be troweled or otherwise shaped to form an exterior surface layer 17 having various designs. The external surface 11*a* of the exterior first panel 11 can include screeds to facilitate troweling. Although the exterior first panel 11 will be substantially enclosed within the set flowable construction material 15, the external surface 11*a* of the exterior first panel 11 may be partially exposed and thus visible in places.

The first panel 11 and second panel 12 are preferably secured to each other by a plurality of plastic or metal connecting members 16 that maintain the panels 11, 12 in a spaced, parallel relationship. As noted above, the first panel 11 is an exterior panel. The second panel 12 can be used for an external exposed wall, for example, where the wall forming assembly 10 is designed to form a free standing wall viewable from both sides. Alternately, the second panel 12 can be used for an internal hidden wall. If used for an external exposed wall, the second panel 12 preferably comprises a plastic or metal lattice framework having a plurality of openings similar to first panel 11. If used for an internal hidden wall, the second panel 12 preferably comprises a solid panel made from plastic, metal, sheetrock, concrete, or the like. The wall forming assembly 10 can be a modular unit, which can be attached to an existing wall or set up as a free standing structure. Alternately, the wall forming assembly 10 can be formed with an existing wall or with natural terrain, such as rock or dirt. Accordingly, the "second panel" can include any structure capable of restraining the flowable construction material 15.

The exterior first panel 11 and the flowable construction material 15 become a substantially monolithic structure when the flowable construction material 15 is set. If the second panel 12 is also a panel having a lattice framework, the second panel 12 would also become part of the substantially monolithic structure when the flowable construction material 15 is set. The embedded lattice framework panel(s) provide structural support to the set flowable construction material 15 and help prevent cracking thereof. The wall forming assembly 10 created by the panels 11, 12 would have a closed bottom end 18, such as a concrete slab or dirt, to restrain the flowable construction material 15. Also, the wall form structure created by the wall forming assembly 10 may have isolated ends that would necessarily need to be capped or formed with a solid panel or lattice framework to restrain the flowable construction material 15.

Figure 8:
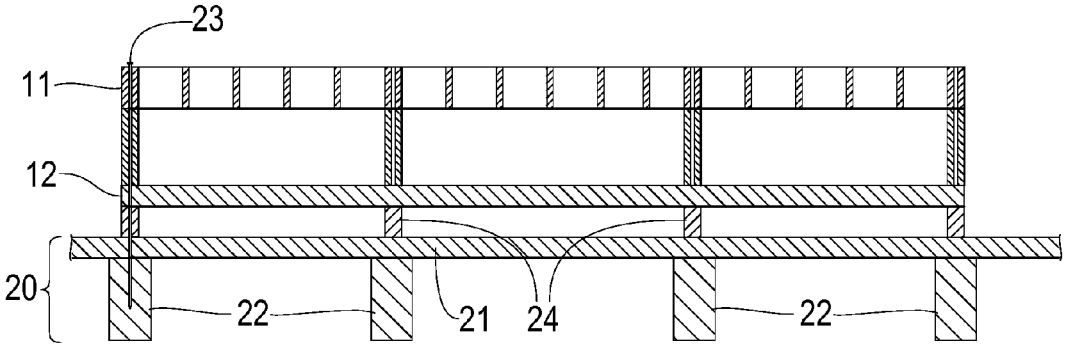
FIG. 8 is a top sectional view of an alternate embodiment of the wall forming assembly of the present invention secured to a pre-existing wall in a spaced relationship.
Figure 9:
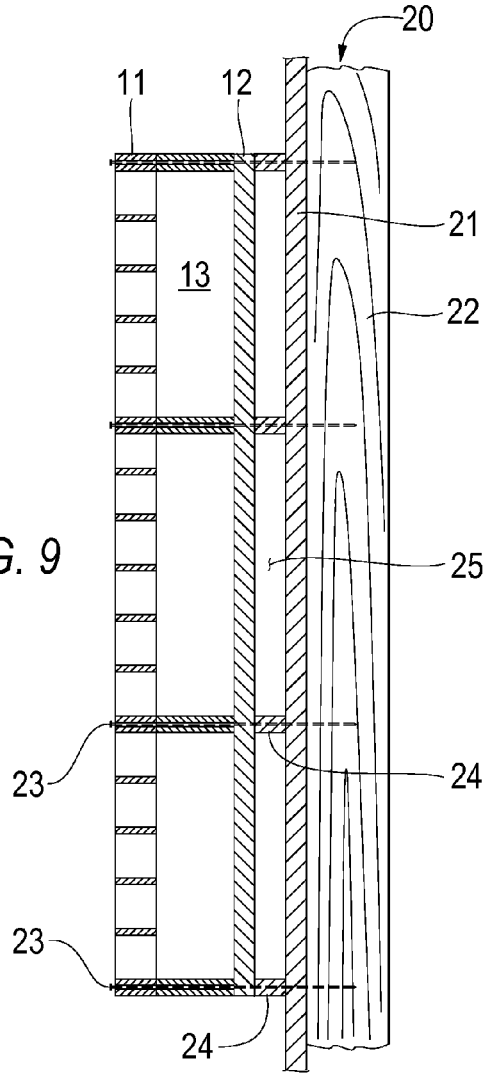
FIG. 9 is a side sectional view of the embodiment of FIG. 8.
Figure 10:
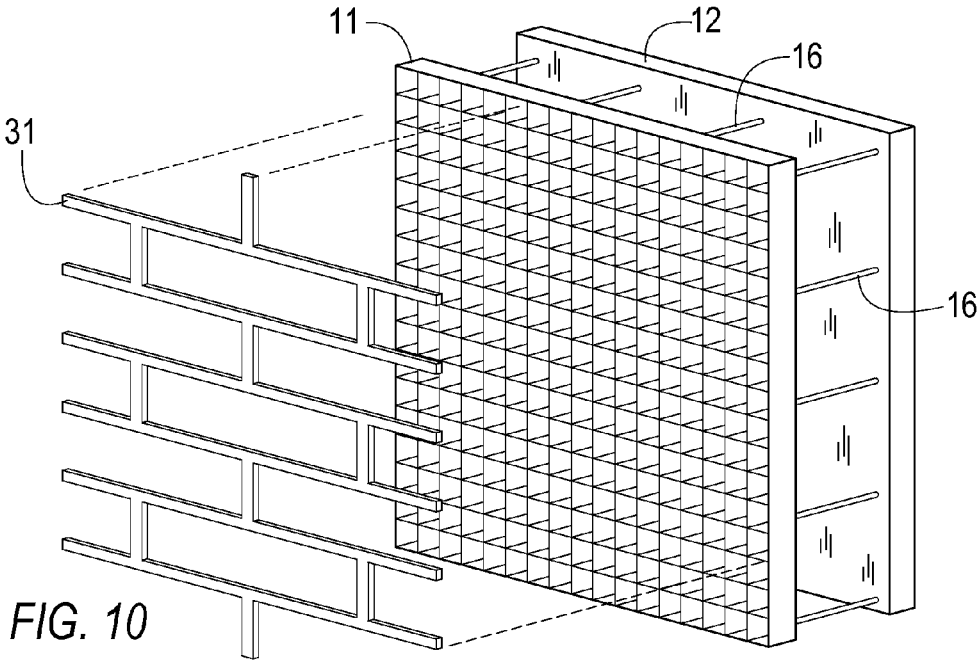
FIG. 10 is a perspective view of an alternate embodiment of the wall forming assembly of the present invention having the stencil exploded from the exterior panel.
Figure 11:
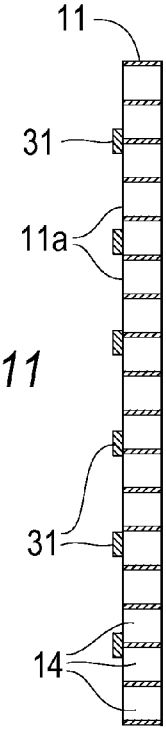
FIG. 11 is a side sectional view of the exterior panel of FIG. 10 having the stencil attached thereto.
Figure 12:
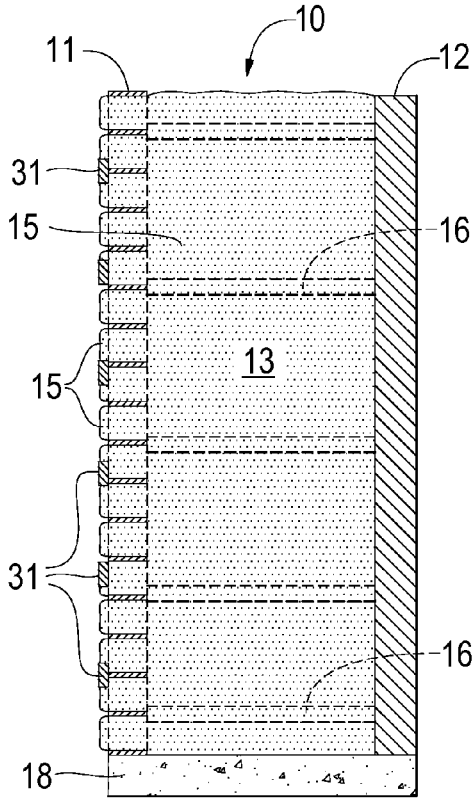
FIG. 12 is a side sectional view of the embodiment of FIG. 10 having a flowable construction material therein.
Figure 13:
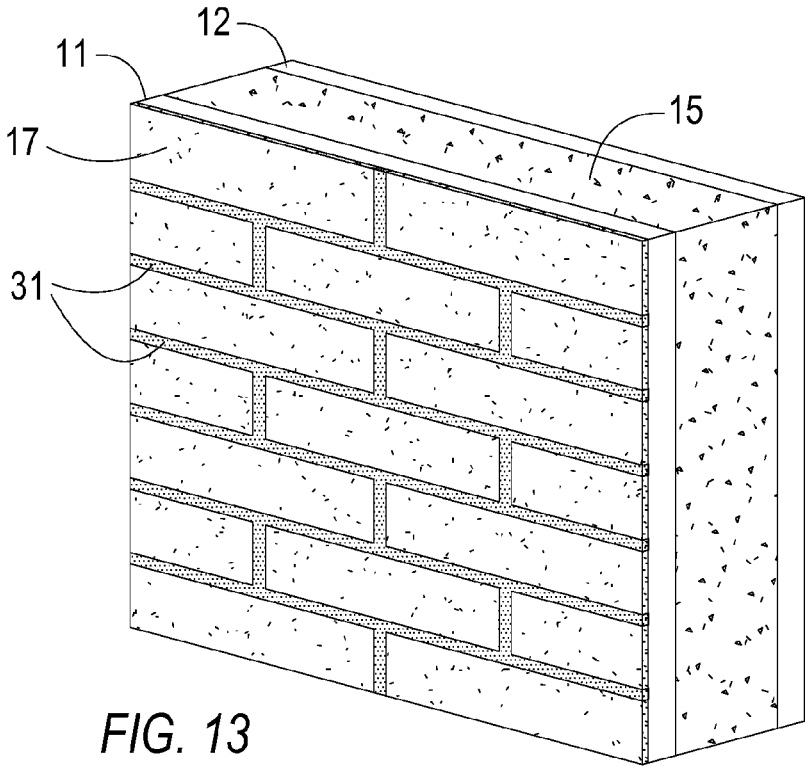
FIG. 13 is a perspective view of the embodiment of FIG. 10 having a flowable construction material therein with the exterior surface finished.

In the embodiment shown in FIGS. 8 and 9, the wall forming assembly 10 is used as a cladding against a pre-existing wall 20, for example, a wall having sheathing 21 secured to studs 22. The wall form assembly 10 can be attached to the pre-existing wall 20 with a plurality of connectors 23, such as screws or nails, which connect the wall form assembly 10 through spacers 24 to pre-existing wall 20. The spacers 24 separate second panel 12 from sheathing 21 to form an air cavity 25 therebetween. If desired, a vapor barrier layer can be inserted between the second panel 12 and the sheathing 21.

Figure 14:
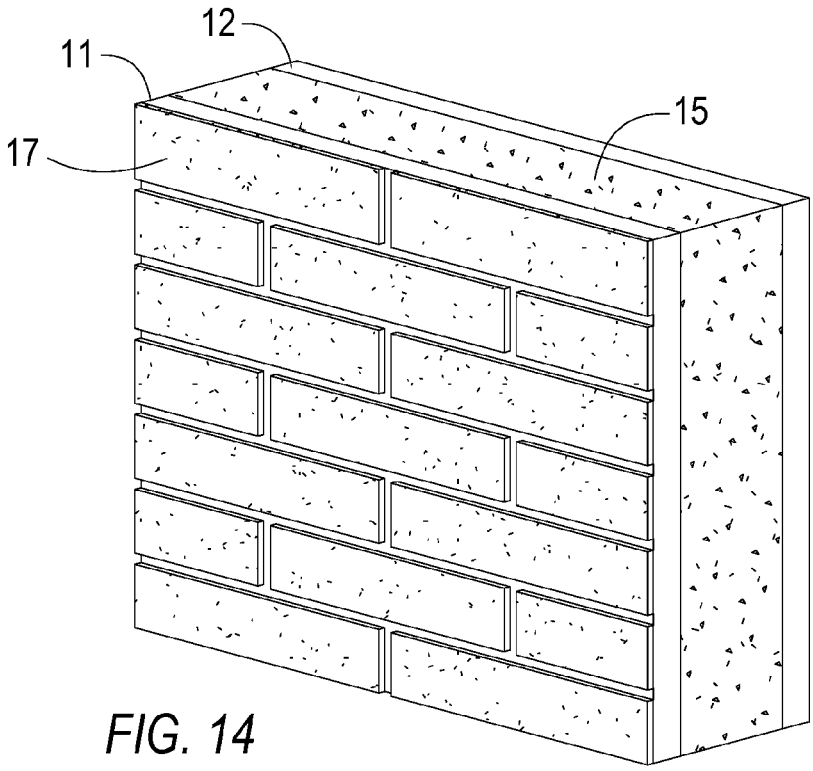
FIG. 14 is a perspective view of the embodiment of FIG. 13 after the stencil has been removed from the exterior panel.

In the embodiment shown in FIGS. 10-14, the wall forming assembly 10 further comprises a stencil 31 attached to the external surface 11*a* of the exterior first panel 11, wherein the stencil 31 can either be left to become part of the finished wall or can be removed before or after the flowable construction material 15 has solidified to provide various relief designs, such as the brick design shown in FIG. 14. If the second panel 12 is also a panel having a lattice framework, the second panel 12 could also have a stencil 31 attached to the external surface of the second panel 12, wherein the stencil 31 can either be left to become part of the finished wall or can be removed before or after the flowable construction material 15 has solidified.

Figure 15:
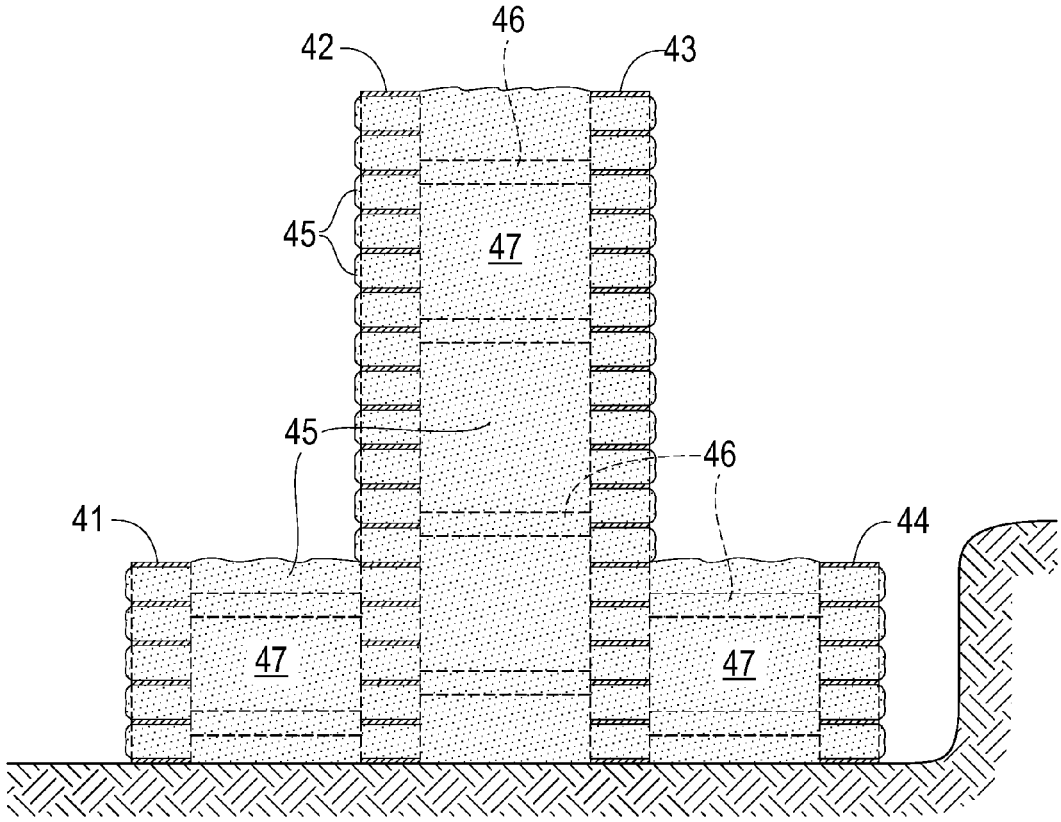
FIG. 15 is a side sectional view of an alternate embodiment of the wall forming assembly of the present invention having a flowable construction material therein.

In the embodiment shown in FIG. 15, the wall forming assembly 10 further comprises additional layers of panels. This embodiment is particularly applicable for forming a plurality of stairs or a free standing wall needing a reinforced foundation. In FIG. 15, the wall forming assembly 10 comprises a first panel 41, a second panel 42, a third panel 43, and a fourth panel 44, wherein the panels are secured to each other with a plurality of connecting members 46. The panels 41, 42, 43, 44 preferably all comprise a plastic or metal lattice framework having a plurality of openings similar to first panel 11 described above. Inner panels 42 and 43 are preferably formed or stacked higher than outer panels 41 and 44. The flowable construction material 45 is introduced into the cavities 47 formed between the panels 41, 42, 43, 44, which traverses the openings as described above. The panels 41, 42, 43, 44 and the flowable construction material 45 become a substantially monolithic structure when the flowable construction material 45 is set. If desired, dirt or the like can be backfilled over panels 41 and 44 up to panels 42 and 43. Also, panels 42 and 43 can have stencils 31 as described above. In other applications, such as forming stairs, any number of panels can be used.

A preferred method of forming a wall having an exterior surface comprises the steps of introducing a flowable construction material into one or more cavities in a wall forming assembly 10 as described above, allowing some of the flowable construction material to flow through the openings in one or more exterior panels such that the flowable construction material extends beyond an external surface of the exterior panel(s), shaping the flowable construction material that extends beyond the external surface of the exterior panel(s) to achieve a desired surface appearance, and waiting for the flowable construction material to solidify such that the exterior panel(s) and the flowable construction material become a substantially monolithic structure. If present, one or more stencils could be removed from the external surface of the exterior panel(s), preferably before the flowable construction material is set. If desired, an exterior coating can be applied to the external surface of the flowable construction material that extends beyond the external surface of the exterior panel(s) to achieve a desired decorative appearance (e.g. color, texture, etc.).

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described above and as recited in the appended claims. For example, the wall forming system as described and claimed herein also finds application in the formation of sidewalks, driveways, and the like.

The invention claimed is:

1. A method of forming a wall, consisting of the steps of:

a) assembling a plurality of wall forming modular units to create a free standing structure, wherein each modular unit consists of a first lattice framework panel having a plurality of openings therethrough, a second solid panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first panel such that said flowable concrete extends beyond an external surface of said first panel;

c) troweling said flowable concrete that extends beyond said external surface of said first panel to form an exterior surface layer; and d) allowing said flowable concrete to set, wherein said first panel, said connecting members, and said flowable concrete become a substantially monolithic structure when said flowable concrete is set.

2. A method of forming a wall, consisting of the steps of:

a) assembling a plurality of wall forming modular units to create a free standing structure, wherein each modular unit consists of a first lattice framework panel having a plurality of openings therethrough, a second solid panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first panel such that said flowable concrete extends beyond an external surface of said first panel;

c) troweling said flowable concrete that extends beyond said external surface of said first panel to form an exterior surface layer;

d) allowing said flowable concrete to set, wherein said first panel, said connecting members, and said flowable concrete become a substantially monolithic structure when said flowable concrete is set; and e) applying an exterior coating to said exterior surface layer to achieve a predetermined decorative appearance.

3. A method of forming a wall, consisting of the steps of:

a) assembling a plurality of wall forming modular units to create a free standing structure, wherein each modular unit consists of a first lattice framework panel having a plurality of openings therethrough, a second lattice framework panel having a plurality of openings therethrough, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first and second panels such that said flowable concrete extends beyond an external surface of said first panel and an external surface of said second panel;

c) troweling said flowable concrete that extends beyond said external surface of said first panel to form a first exterior surface layer and said flowable concrete that extends beyond said external surface of said second panel to form a second exterior surface layer; and d) allowing said flowable concrete to set, wherein said first panel, said second panel, said connecting members, and said flowable concrete become a substantially monolithic structure when said flowable concrete is set.

4. A method of forming a wall, consisting of the steps of:

a) assembling a plurality of wall forming modular units to create a free standing structure, wherein each modular unit consists of a first lattice framework panel having a plurality of openings therethrough, a second lattice framework panel having a plurality of openings therethrough, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first and second panels such that said flowable concrete extends beyond an external surface of said first panel and an external surface of said second panel;

c) troweling said flowable concrete that extends beyond said external surface of said first panel to form a first exterior surface layer and said flowable concrete that extends beyond said external surface of said second panel to form a second exterior surface layer;

d) allowing said flowable concrete to set, wherein said first panel, said second panel, said connecting members, and said flowable concrete become a substantially monolithic structure when said flowable concrete is set; and e) applying an exterior coating to said first exterior surface layer to achieve a predetermined decorative appearance.

5. A method of forming a wall, consisting of the steps of:

a) assembling a plurality of wall forming modular units to create a free standing structure, wherein each modular unit consists of a first lattice framework panel having a plurality of openings therethrough, a second lattice framework panel having a plurality of openings therethrough, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first and second panels such that said flowable concrete extends beyond an external surface of said first panel and an external surface of said second panel;

c) troweling said flowable concrete that extends beyond said external surface of said first panel to form a first exterior surface layer and said flowable concrete that extends beyond said external surface of said second panel to form a second exterior surface layer;

d) allowing said flowable concrete to set, wherein said first panel, said second panel, said connecting members, and said flowable concrete become a substantially monolithic structure when said flowable concrete is set;

e) applying an exterior coating to said first exterior surface layer to achieve a predetermined decorative appearance; and f) applying an exterior coating to said second exterior surface layer to achieve a predetermined decorative appearance.

6. A method of forming a wall, consisting of the steps of:

a) assembling a plurality of wall forming modular units to create a free standing structure, wherein each modular unit consists of a first lattice framework panel having a plurality of openings therethrough, a detachable stencil attached to an external surface of said first panel, a second solid panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first panel such that said flowable concrete extends beyond said external surface of said first panel;

c) troweling said flowable concrete that extends beyond said external surface of said first panel to form an exterior surface layer;

d) removing said stencil from said external surface of said first panel to form a predetermined decorative design in said exterior surface layer; and e) allowing said flowable concrete to set, wherein said first panel, said connecting members, and said flowable concrete become a substantially monolithic structure when said flowable concrete is set.

7. A method of forming a wall, consisting of the steps of:

a) assembling a plurality of wall forming modular units to create a free standing structure, wherein each modular unit consists of a first lattice framework panel having a plurality of openings therethrough, a detachable stencil attached to an external surface of said first panel, a second solid panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first panel such that said flowable concrete extends beyond said external surface of said first panel;

c) troweling said flowable concrete that extends beyond said external surface of said first panel to form an exterior surface layer;

d) applying an exterior coating to said exterior surface layer to achieve a predetermined decorative appearance;

e) removing said stencil from said external surface of said first panel to form a predetermined decorative design in said exterior surface layer; and f) allowing said flowable concrete to set, wherein said first panel, said connecting members, and said flowable concrete become a substantially monolithic structure when said flowable concrete is set.

8. A method of forming a wall, consisting of the steps of:

a) assembling a plurality of wall forming modular units to create a free standing structure, wherein each modular unit consists of a first lattice framework panel having a plurality of openings therethrough, a first detachable stencil attached to an external surface of said first panel, a second lattice framework panel having a plurality of openings therethrough, a second detachable stencil attached to an external surface of said second panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first and second panels such that said flowable concrete extends beyond said external surface of said first panel and said external surface of said second panel;

c) troweling said flowable concrete that extends beyond said external surface of said first panel to form a first exterior surface layer and said flowable concrete that extends beyond said external surface of said second panel to form a second exterior surface layer;

d) removing said first stencil from said external surface of said first panel to form a predetermined decorative design in said first exterior surface layer and said second stencil from said external surface of said second panel to form a predetermined decorative design in said second exterior surface layer; and e) allowing said flowable concrete to set, wherein said first panel, said second panel, said connecting members, and said flowable concrete become a substantially monolithic structure when said flowable concrete is set.

9. A method of forming a wall, consisting of the steps of:

a) assembling a plurality of wall forming modular units to create a free standing structure, wherein each modular unit consists of a first lattice framework panel having a plurality of openings therethrough, a first detachable stencil attached to an external surface of said first panel, a second lattice framework panel having a plurality of openings therethrough, a second detachable stencil attached to an external surface of said second panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first and second panels such that said flowable concrete extends beyond said external surface of said first panel and said external surface of said second panel;

c) troweling said flowable concrete that extends beyond said external surface of said first panel to form a first exterior surface layer and said flowable concrete that extends beyond said external surface of said second panel to form a second exterior surface layer;

d) applying an exterior coating to said first exterior surface layer to achieve a predetermined decorative appearance;

e) removing said first stencil from said external surface of said first panel to form a predetermined decorative design in said first exterior surface layer and said second stencil from said external surface of said second panel to form a predetermined decorative design in said second exterior surface layer; and f) allowing said flowable concrete to set, wherein said first panel, said second panel, said connecting members, and said flowable concrete become a substantially monolithic structure when said flowable concrete is set.

10. A method of forming a wall, consisting of the steps of:

a) assembling a plurality of wall forming modular units to create a free standing structure, wherein each modular unit consists of a first lattice framework panel having a plurality of openings therethrough, a first detachable stencil attached to an external surface of said first panel, a second lattice framework panel having a plurality of openings therethrough, a second detachable stencil attached to an external surface of said second panel, and a plurality of connecting members securing said first panel to said second panel in a spaced, parallel relationship such that a cavity is formed between said first and second panels for receiving flowable concrete therein;

b) introducing said flowable concrete into said cavity, wherein said flowable concrete fills said cavity and extends through said openings through said first and second panels such that said flowable concrete extends beyond said external surface of said first panel and said external surface of said second panel;

c) troweling said flowable concrete that extends beyond said external surface of said first panel to form a first exterior surface layer and said flowable concrete that extends beyond said external surface of said second panel to form a second exterior surface layer;

d) applying an exterior coating to said first exterior surface layer to achieve a predetermined decorative appearance;

e) applying an exterior coating to said second exterior surface layer to achieve a predetermined decorative appearance;

f) removing said first stencil from said external surface of said first panel to form a predetermined decorative design in said first exterior surface layer and said second stencil from said external surface of said second panel to form a predetermined decorative design in said second exterior surface layer; and g) allowing said flowable concrete to set, wherein said first panel, said second panel, said connecting members, and said flowable concrete become a substantially monolithic structure when said flowable concrete is set.

* * * * *